US006094796A

United States Patent [19]

Biro

[11] Patent Number: 6,094,796

[45] Date of Patent: Aug. 1, 2000

[54] MANUFACTURING METHOD FOR A VALANCE

[76] Inventor: Michael Julius Biro, 4014 NW. 24th Ter., Boca Raton, Fla. 33431

[21] Appl. No.: 08/965,679

[22] Filed: Nov. 6, 1997

[51] Int. Cl.[7] ..... B23P 15/00

[52] U.S. Cl. ..... 29/463; 29/412

[58] Field of Search ..... 403/401, 402; 248/220.1; 160/19, 38, 39; 29/463, 412; 52/211, 213, 718.04; 49/504

[56] References Cited

U.S. PATENT DOCUMENTS

| | | |
|---|---|---|
| 653,484 | 7/1900 | McCullough . |
| 2,004,262 | 6/1935 | Widman . |
| 2,513,628 | 7/1950 | Eaglin . |
| 2,804,952 | 9/1957 | Nothdurft . |
| 3,378,057 | 4/1968 | Synck . |
| 3,429,602 | 2/1969 | Dirilgen . |
| 3,782,054 | 1/1974 | Goss, Jr. . |
| 4,240,765 | 12/1980 | Offerdinger . |
| 4,254,813 | 3/1981 | Vecchiarelli . |
| 4,646,801 | 3/1987 | Hines . |
| 4,955,419 | 9/1990 | Morris . |
| 5,039,049 | 8/1991 | Niemi . |
| 5,042,548 | 8/1991 | Attal . |
| 5,378,077 | 1/1995 | Paulsen . |
| 5,383,508 | 1/1995 | Pavlica et al. . |
| 5,465,516 | 11/1995 | Stabile . |
| 5,636,674 | 6/1997 | Benthin . |
| 5,704,410 | 1/1998 | Kuo . |

FOREIGN PATENT DOCUMENTS

| | | | |
|---|---|---|---|
| 849517 | 9/1960 | United Kingdom | 160/19 |

*Primary Examiner*—I Cuda
*Attorney, Agent, or Firm*—Ronald V. Davidge

[57] ABSTRACT

A manufacturing process includes mitering each end of a central member and mitering a single end of each of two end members formed, along with the central member, from a single piece of extruded stock having an inner surface including upper and lower attachment slots and an outer surface including upper and lower trim receiving slots. An "L"-shaped corner bracket is placed to extend within the upper and lower attachment slots at each end of the central member and between such slots at the mitered ends of the end members. A heat forming process is then applied to form corners of a decorative trim strip which is then placed to extend between the upper and lower trim receiving slots of the end members and the central members.

11 Claims, 6 Drawing Sheets

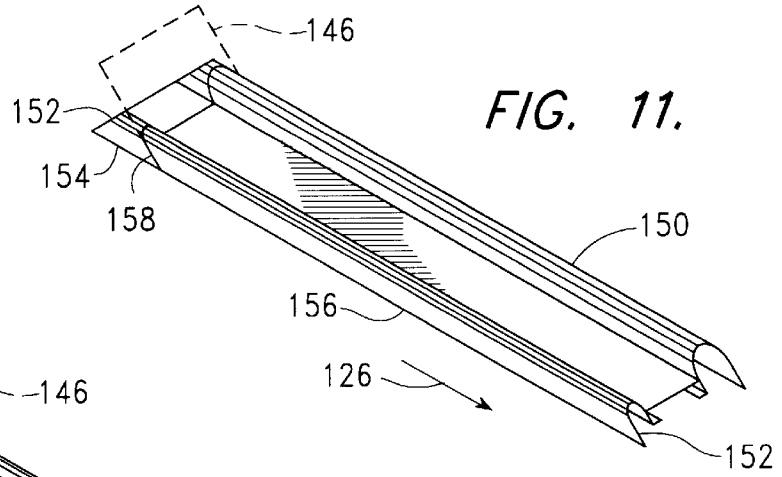
FIG. 11.
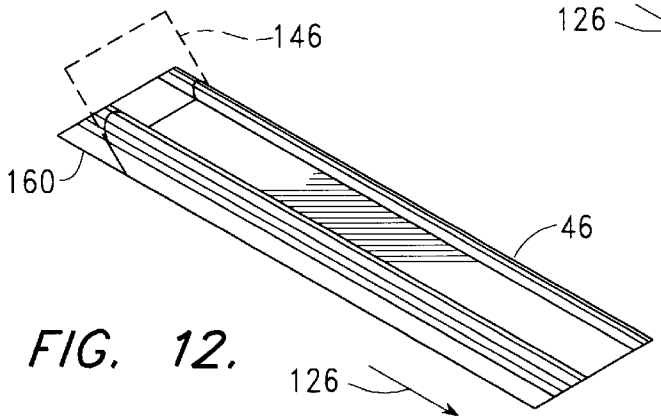
FIG. 12.
FIG. 13.
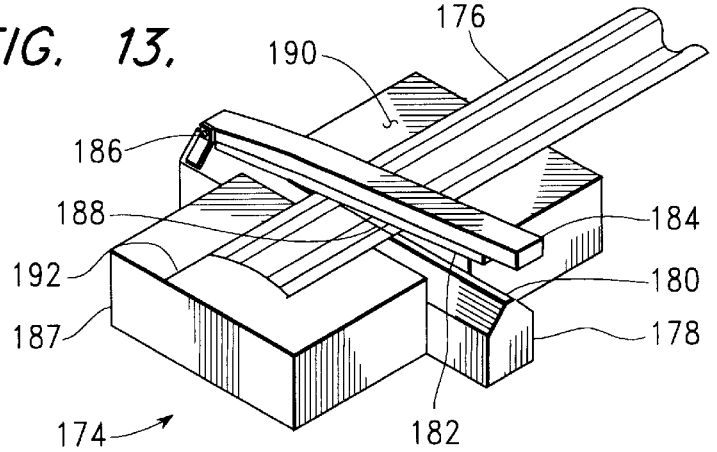

MANUFACTURING METHOD FOR A VALANCE

BACKGROUND OF THE INVENTION

1. Field of the Invention

This invention relates to a decorative valance for attachment at the top of a window around a mechanism for the attachment and movement of a window covering, and, more particularly, to a manufacturing method combining mitered sections of extruded stock with a heat-formed decorative trim strip to form such a valance.

2. Background Information

Valances, or cornices, have been used for many years as interior decorations covering the mechanisms for attachment and movement of window coverings, such as curtains, drapes, shades, and blinds. Such mechanisms are typically adjacent the top of windows, with the window coverings hanging downward therefrom. For example, valances where used to cover the cord and pulley arrangements used to operate pull-up curtains developed in Europe in the latter part of the seventeenth century.

Due to the large number of widths and types of windows, and due to the variety of window coverings which must be accommodated, conventional methods for making valences have relied on materials cut to size and assembled for individual windows. For example, early valances were wooden box structures covered with fabric. More recently, buckram has been used, being fastened along the front face and ends of a board mounted to the wall above a window by means of brackets. The buckram covering, which is composed of a coarse linen or hemp cloth stiffened by sizing, is cut to shape, extending downward from the board to a decorative edge having, for example, a scalloped pattern, and folded at the corners to form return sections extending along the ends of the board to the wall.

Another trend in window coverings has been the replacement of soft draperies and curtains with relatively hard materials having straight edges, such as vertical blinds. These new materials are individualized by means of colors and textures. Valences composed of extruded plastic structures covered with decorative strips are used to match the visual effect of these window coverings. The decorative strip may be, for example, the same material and color as the vertical blind strips descending from a valance. A valance of this type conventionally consists of a front member extending above the window and of a end member extending toward the wall at each end of the front member.

A particular problem with this type of valance concerns the treatment of the decorative strip at the corners where the front member and the end members are joined. One conventional method of dealing with this problem has been to terminate the decorative strip at the corner, so that the portions of the decorative strip extending along the end members of the valance are separate from the portion extending along the front member thereof. A problem with this method arises from the fact that the decorative strips do not lie flat; they are bowed so that an aesthetically undesirable large gap is seen between the strip members extending in mutually perpendicular directions away from the corner.

Another conventional method for dealing with the decorative strip at the valance corners is to provide an underlying corner member providing a gentle curve between the flat surfaces on which the strip is held in the strip is held in the end and front members. When the valance is assembled, the strip is curved around each corner member at a generous radius established by the corner member. This generous radius is needed to allow the curvature of the strip. One disadvantage of this method is overall appearance of the finished valance is established and therefore limited by the method chosen for handling the corners. The overall appearance is one of straight lines and flat surfaces being joined by curved surfaces having generous radii. This type of appearance was popularized in the mid- to late-1930's, being incorporated into the cover designs of clocks, radios, thermostats, etc.

Thus, what is needed is a method for manufacturing a valance having an accurately formed corner with a more modern squared appearance, around which a continuous decorative strip is formed.

Furthermore, valances made with joined extrusions tend to have central members extending rearward toward the wall for attachment to the end members, which are made from stock of differing cross members. What is needed is a method allowing relatively thin extrusions, common with one another, to be joined at mitered edges.

SUMMARY OF THE INVENTION

Thus, a first objective of the present invention is to provide a method for manufacturing a valance having a central member, two end members, and a decorative strip formed at square corners to extend along the central member and end members.

Another objective of the present invention is to provide a method for manufacturing a valance having minimum complexity where the central and end members are joined at corners.

Another objective of the present invention is to provide a method for manufacturing a valance having a central member and end members formed from common extruded stock.

Another objective of the present invention is to provide a method for manufacturing a valance suitable to extend within a bay window.

Another objective of the present invention is to provide a method for manufacturing a valance including downward hanging fabric materials which can be easily removed for cleaning and replaced.

In accordance with an aspect of the present invention, there is provided a method for constructing a valance from materials comprising an elongated structural member having a uniform transverse sectional shape, including an inner surface with a downwardly disposed upper attachment slot and an upwardly disposed lower attachment slot, and an outer surface with a downwardly directed upper trim strip receiving slot and an upwardly directed lower trim strip receiving slot, a trim strip, and first and second "L"-shaped brackets, wherein the method includes steps of:

a) cutting the elongated structural member to form a central member and first and second end members, with the central member extending between mitered ends, and with each the end member extending between a mitered and a squared end;

b) assembling the mitered end of the first end member to a first mitered end of the central member, with a first side of the first "L"-shaped bracket extending within the upper and lower attachment slots of the first end member, and with a second side of the first "L"-shaped bracket extending within the upper and lower attachment slots of the central member;

c) assembling the mitered end of the second end member to a second mitered end of the central member, with a first side of the first "L"-shaped bracket extending within the upper and lower attachment slots of the second end member, and with a second side of the second "L"-shaped bracket extending within the upper and lower attachment slots of the central member;

d) forming the trim strip into a central portion essentially equal in length to the central member and first and second end portions extending in an inward direction essentially perpendicular to the central porion; and e) inserting an upper edge of the central portion of the trim strip into the upper trim strip receiving slot within the central member, a lower edge of the central portion of the trim strip into the lower trim strip receiving slot within the central member, an upper edge of the first end portion of the trim strip into the upper trim strip receiving slot within the first end member, a lower edge of the first end portion of the trim strip into the lower trim strip receiving slot within the first end member, an upper edge of the second end portion of the trim strip into the upper trim strip receiving slot within the second end member, and a lower edge of the second end portion of the trim strip into the lower trim strip receiving slot within the second end member.

In accordance with another aspect of the invention, there is provided a bracket, including upper and lower sections, for connecting upper and lower valance frames. The upper section has upper and lower tabs for removably engaging features of the upper valance frame. The lower section, which is pivotally mounted on the upper section, has first and second tabs for removably engaging features of the lower valance frame.

BRIEF DESCRIPTION OF THE DRAWINGS

FIG. 11 is an isometric view schematically showing a first end of a central member within the valance of FIG. 2 being cut within the sawing station of FIG. 8;

FIG. 12 is an isometric view schematically shown a second end of a central member within the valance of FIG. 2 being cut within the sawing station of FIG. 8;

FIG. 13 is an isometric view of a heating station used in heat forming a trim strip of the valance of FIG. 2;

DETAILED DESCRIPTION

Figure 1:
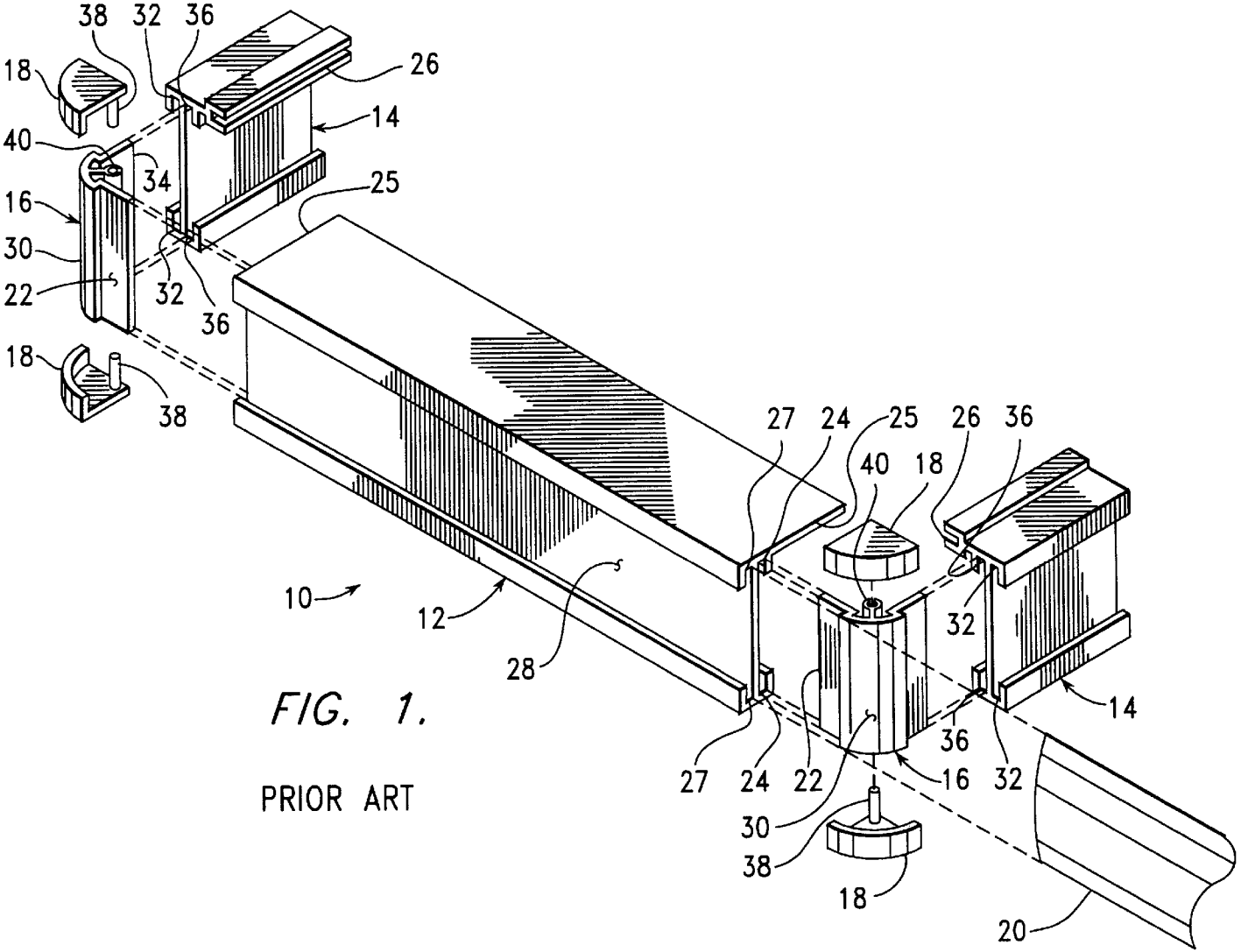
FIG. 1. PRIOR ART
FIG. 1 is an exploded isometric view of a valance built in accordance with conventional methods.

FIG. 1 is an exploded isometric view of a valance 10 built in accordance with conventional methods. This valance 10 includes a central member 12, a pair of end members 14, a pair of rounded corner members 16, four rounded flange members 18, and a decorative strip 20. In the process of assembly, tabs 22 of rounded corner members 16 are pressed into slots 24 extending along a rear surface of the central member 12, and the decorative strip 20 is slid into slots 26 extending along a central surface 28 of the central member 12. The decorative strip 20 is formed around curved surfaces 30 of rounded corner members 16 to extend within slots 32 or each end member 14 as these members are pressed in place, with a tab 34 of a rounded corner member 16 extending into the slots 36 of an adjacent end member 14. Finally, a pair of rounded flange members 18 are pressed into place from above and below each rounded corner member 16, with a pin 38 from each flange member 18 extending into a slotted hole 40 within the corner m ember 16.

Figure 2:
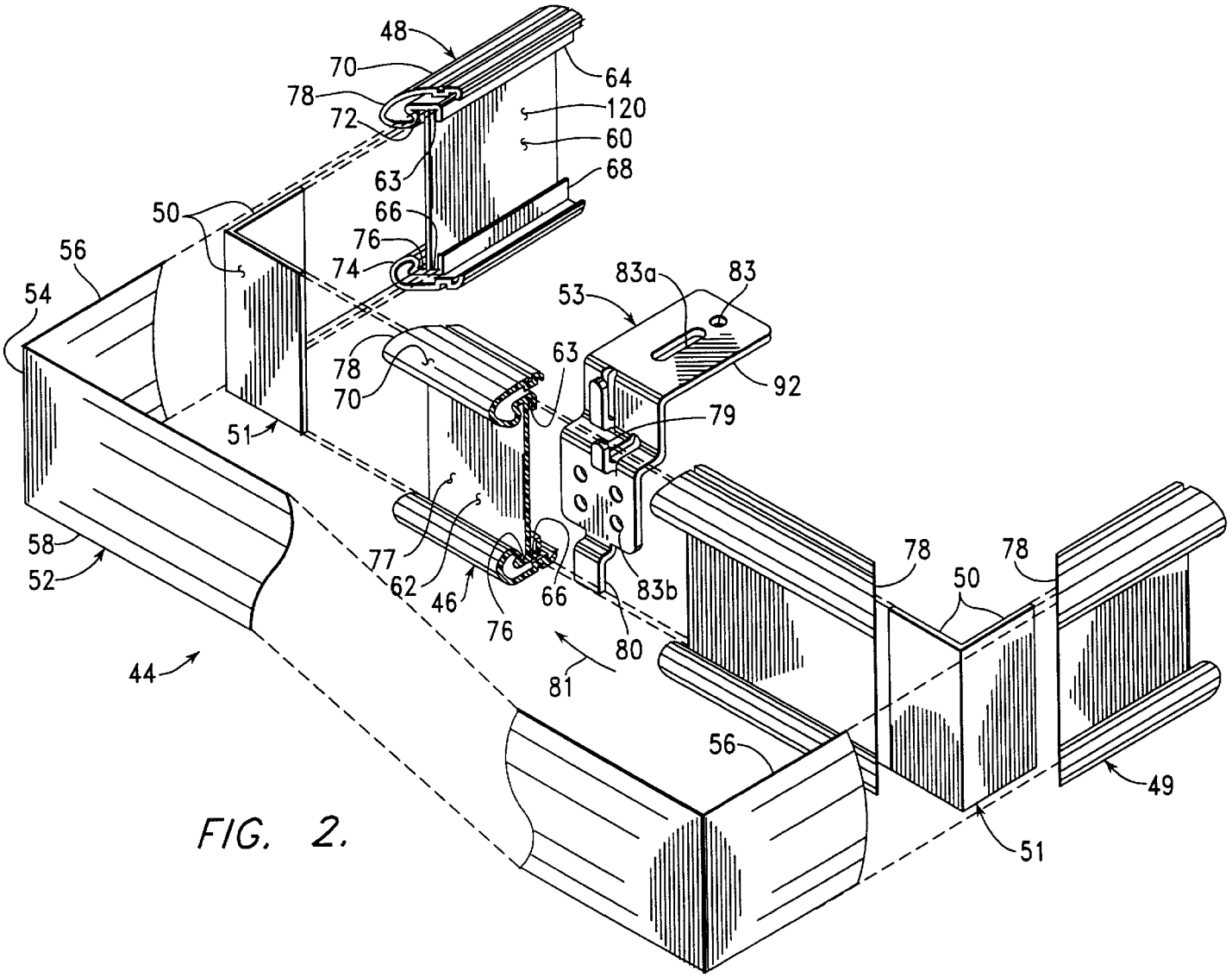
FIG. 2 is a fragmentary exploded isometric view of a valance built in accordance with the present invention.

FIG. 2 is an exploded isometric view of a valance 44 built in accordance with the present invention. This valance 44 includes a central member 46, a pair of end members 48, 49, a pair of corner brackets 50, and a decorative strip 52. The central member 46 is depicted with a central section removed to show a mounting bracket 53 used to attach the valance 44 to surfaces of the building structure (not shown). The central member 46 and the end members 48, 49 are members of a frame generally built to extend adjacent a window. The decorative strip 52 is heat-formed at corners 54, which define end strip portions 56 and a central strip portion 58. The end members 48, 49 and the central member 46 are similar in transverse crosssection, and may therefore be cut from the same extruded plastic stock, which includes an inner surface 60 and an outer surface 62. The inner surface 60 has an upper attachment slot 63, extending within an inward-extending "L"-shaped section 64, and a lower attachment slot 66, extending within an inward-extending "L"-shaped section 68. The outer surface 62 includes an outward-extending upper decorative curved portion 70, which returns inward to form an upper trim strip receiving slot 72. The outer surface 62 further includes an outward-extending lower decorative curved portion 74, which returns inward to form a lower trim strip receiving slot 76. These trim strip receiving slots 72, 76 extend along opposite sides of a planar trim strip receiving surface 77, along which the trim strip 52 extends. To achieve a desired aesthetic effect, upper curved portion 70 extends farther outward than lower curved portion 74.

The mating edges 78 of central member 46 and of end members 48, 49 are mitered, being individually cut along a plane extending at a 45-degree angle to the planar trim strip receiving surface 77. Cutting these members 46, 48, 49 in this way ensures that a trim strip formed along a line extending perpendicularly between its longitudinal edges will extend within the planar trim strip receiving surfaces of each member. The two sides of 50 each corner bracket 51 extend into attachment slots 63, 66 of the central member 46 and of the adjoining end members 48, 49. The upper edge of decorative strip 52 extends within upper trim strip receiving slots 72 of the central member 46 and of end members 48, 49. The lower edge of decorative strip 52 extends within lower trim strip receiving slots 76 of the central member 46 and of end members 48, 49.

Mounting bracket 53 incudes an upper tab 79 and a lower tab 80, which are formed in alignment with one another to engage the surfaces of upper attachment slot 63 and lower attachment slot 66, respectively. The bracket 53 is brought into engagement with the central member 46, being rotated through an angle in the direction of arrow 81 which is sufficient to allow the movement of tabs 79, 80 past the "L"-shaped structures 64, 68, and being subsequently rotated opposite the direction of arrow 81 so that the tabs 79, 80 are rotated into engagement within the slots 63, 66. The bracket 53 also includes a rearward-extending attachment tab 82 having a hole 83 and a slot 83*a*, which may be used, for example, to attach the bracket 53 to the ceiling of a structure in which the valance 44 is to be placed. The bracket 53 also includes additional holes 83*b*, which may be used to mount the bracket 53 to a vertical surface of another bracket.

Figure 3:
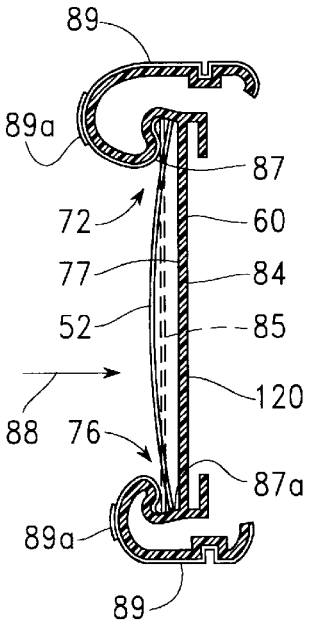
FIG. 3 is a transverse cross-sectional view of a frame member within the valance of FIG. 2, together with a trim strip fastened thereto.

FIG. 3 is a transverse cross sectional view of an elongated member 84 from which the central member 46 and both of the end members 48, 49 (shown in FIG. 2) are made, along with the trim strip 52. These three members 46, 48, and 49 are thus identical in transverse sectional shape. The trim strip 52 is naturally bowed outward, as it is shown with solid lines in FIG. 3. However, each heat-formed corner 54 (shown in FIG. 2) forces the trim strip 52 into a flat condition, as indicated by dashed lines 85 in FIG. 3.

Referring to FIGS. 2 and 3, it is particularly desirable to provide a means for holding the trim strip 52 in place, within both the upper trim strip receiving slot 72 and the lower trim strip receiving slot 76, while also providing for changes in the width of the trim strip 52, caused, for example, by the difference in the effective width of the trim strip between its flat and bowed conditions. Where the trim strip 52 is in its bowed condition, its edges are urged toward the trim strip receiving surface 77, through contact with outer slot surfaces 87. Where the trim strip is in its flat condition, it can move around within the slots 72, 76. Thus, the slot end surfaces 87*a* are inclined toward one another to provide a decreased width at the trim strip receiving surface 77. The tolerance for variation in width of the trim strip 52 allows this strip 52 to be brought into engagement within the slots 72, 76 by movement generally in the normal direction of arrow 88, with the flattened end portions being snapped into place. This capability is particularly important, since the central strip portion 58 of preformed trim strip 52 must be brought into place within the trim strip receiving slots 72, 76 of central member 46 in a normal direction while end strip portions 56 are slid within the trim strip receiving slots 72, 76 of end members 48, 49. The tolerance thus provided for the engagement of the trim strip 52 within the slots 72, 76 also provides a tolerance for variations in the difference between the length of central strip portion 58 and the length of central member 46.

In accordance with a preferred method of the present invention, the elongated member 84 includes decorative coatings 89 extending along its visible surfaces, which exclude the surface hidden by trim strip 52 and inner surface 60. The decorative coating 89, being a thin layer covering the readily visible surfaces of the elongated member 84, may include coloring and texturing agents raising the cost of the material, of which this coating 89 is composed, to a level several times as high as that of the material composing the remaining portion of the elongated member 84 without substantially increasing the cost of the finished product. The elongated member 84 may also include one or more decorative adhesive strips 89*a*, providing, for example, a bright gold or silver finished appearance. The decorative adhesive strips 89*a* may be used in addition to, or in place of, decorative coatings 89. Both the decorative coating 89 and the adhesive strips 89*a* are applied to the elongated member 84 before it is cut up to form central member 46 and end members 48, 49, with these decorative features 89, 89*a* being brought into alignment as the members 46, 48, and 49 are subsequently assembled together.

The valance 44, having been built according to the present invention has a number of advantages over the conventional valance 10, shown in FIG. 1. The valance 44 is formed to show the desired appearance of squared corners on the trim strip. A single type of extruded stock is used both for the central member 46 and for the end members 48, 49. Attachment slots 63, 66 are used both for corner attachment with brackets 51 and for the attachment of the valance to the structure (not shown) in which it is placed, through one or more attachment brackets 53. The use of decorative coatings 89 allows wide variations in the appearance of the product without substantially increasing its manufacturing cost.

A preferred process for manufacturing the valance shown in FIGS. 2 and 3 will now be discussed, with particular reference being made to FIGS. 4–14. This discussion begins with manufacturing the elongated section 84 (shown in FIG. 3) by means of an extrusion process using a die set shown in FIGS. 4–7. The elongated section 84 is composed of a thermoplastic material which may be formed by means of the extrusion process, such as polyvinyl chloride (PVC).

Figure 4:
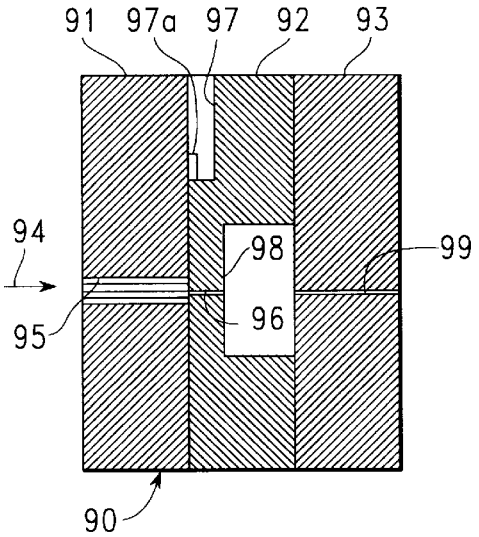
FIG. 4 is a longitudinal cross-sectional view of a die set used to produce an extrusion forming the frame member of FIG. 3.
Figure 5:
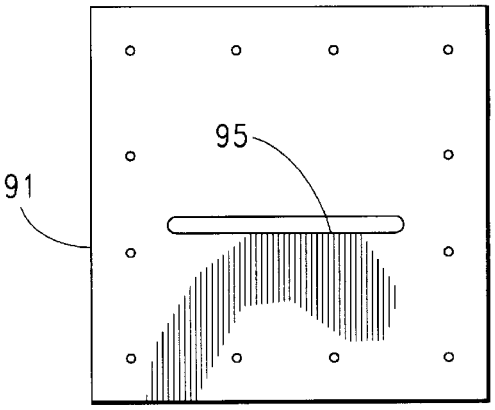
FIG. 5 is an end elevational view of a first die within the die set of FIG. 4.
Figure 6:
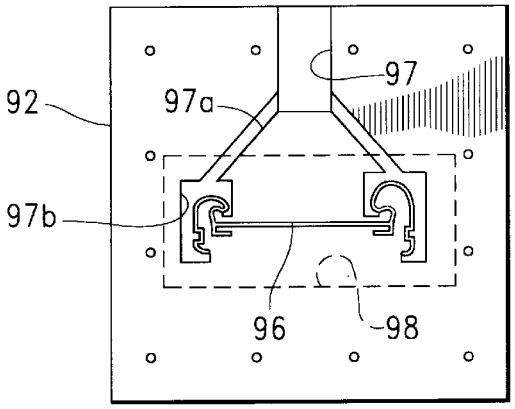
FIG. 6 is an end elevational view of a second die within the die set of FIG. 4.
Figure 7:
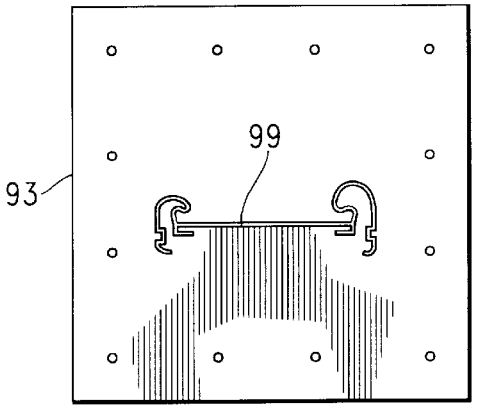
FIG. 7 is an end elevational view of a third die within the die set of FIG. 5.

Thus, FIGS. 4–7 are views of an extrusion die set 90 used to form the elongated section 84 (shown in FIG. 3), with FIG. 4 being a longitudinal cross sectional view of the die set 90, while FIG. 5 is an end elevation of first die 91 therein, FIG. 6 is an end elevation of a second die 92 therein, and FIG. 7 is an end elevation of a third die 93 therein. Each of the end elevations, FIGS. 5, 6, 7, are taken in the direction of arrow 94.

Referring to FIGS. 4 and 5, under conditions of elevated temperature and pressure, a first softened thermoplastic material is driven into a slot 95 of first die 91, by means of a first extruding machine (not shown), which may be of a type well known to those of skilled in the art of making plastic extrusions. Movement through this first slot 95 forms the thermoplastic material to have an essentially rectangular transverse cross-sectional shape with rounded ends.

Referring to FIGS. 3, 4 and 6, second die 92 includes an aperture 96 having a shape which is approximately the transverse sectional shape desired for the elongated section 84. Also under conditions of elevated temperature and pressure, a second softened thermoplastic material is driven into a slot 97 within the second die 92, by means of a second extruding machine (also not shown), which may also be of a type well known to those skilled in the art of making plastic extrusions. This second thermoplastic material, which is also of a type, such as PVC, capable of being formed into specific shapes through the extrusion process, includes coloring agents determined to produce an aesthetically attractive appearance in the visible portions of the valance made using the elongated section 84. The second thermoplastic material flows under pressure from the slot 97 through channels 97*a* into troughs 97*b* extending adjacent the portions of the aperture 96 corresponding to surfaces of the elongated extrusion 84 to be covered with decorative coatings 89. The first and second thermoplastic materials flow through aperture 96 in the direction of arrow 94, with the second thermoplastic material flowing in a layer extending along the adjacent surfaces of the first material to form the decorative coatings 89, into a chamber 98 within the second die 92. Within this chamber 98, compressive stresses within the extruded material are reduced.

Referring to FIGS. 3, 4, and 7, the extruded material leaving die 92 in the direction of arrow 94 is driven through an aperture 99 in the third die 93. This aperture 99 also has a shape which is approximately the transverse sectional shape desired for the elongated section 84. The extruded material then flows through aperture 99 in the direction of arrow 94 onto a conveyor system (not shown) on which it is cooled and cut into desired lengths.

Figures 8, 9, 10:
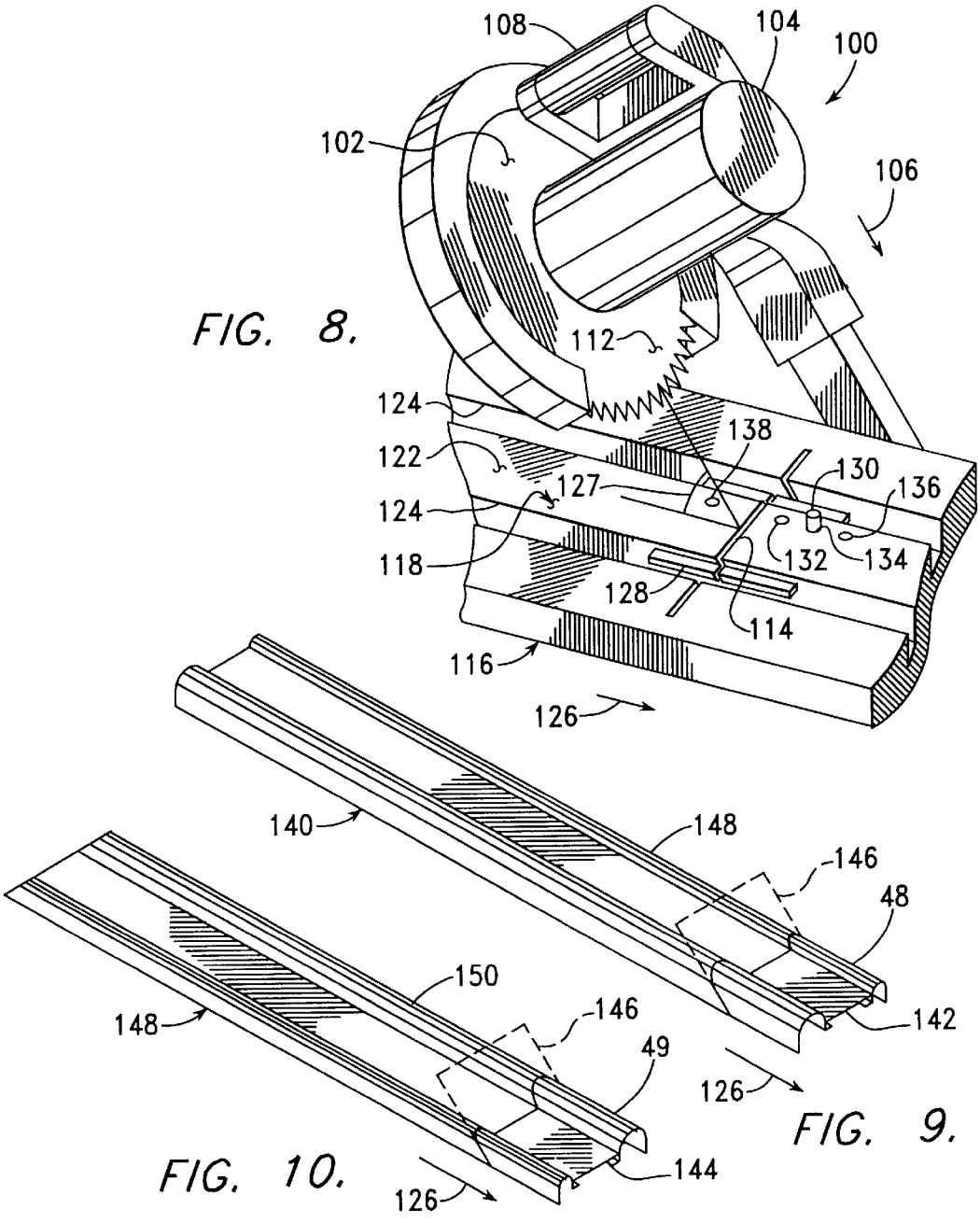
FIG. 8 is a perspective view of a sawing station used to mitered edges of members within the valance of FIG. 2.
FIG. 9 is an isometric view schematically showing a first end member of the valance of FIG. 2 being cut within the sawing station of FIG. 8.
FIG. 10 is an isometric view schematically showing a second end member of the valance of FIG. 2 being cut within the sawing station of FIG. 8.

FIG. 8 is a perspective view of a sawing station 100 used to form the mitered edges 78 of central member 46 and end members 48, 49 of the valance shown in FIG. 2.

Referring to FIGS. 2 and 8, the sawing station 100 includes a rotary saw blade 102 driven in rotation by a motor 104 and movable in the direction of arrow 106 by depressing a handle 108. While a safety guard 110 extends around most of the periphery of saw blade 102, the exposed portion 112 of the saw blade 102 can be moved downward, in the direction of arrow 106, into a slot 114 within a guiding fixture 116. The guiding fixture 116 includes a number of longitudinally extending surfaces 118, which are configured for engaging longitudinally extending features of an extruded member (not shown) used to form the central member 46 and the end members 48, 49.

Since the extruded member is an elongated member having the transverse sectional shape of central member 46 and end members 48, 49, the reference numerals identifying portions of these members 46, 48, and 49 are used herein to describe features of the extruded member. To form mitered edges 78, the extruded member, or a portion thereof, is placed on the guiding fixture with outer surface 62 facing upward, and with a flat portion 120 of the inner surface 60 planar trim strip receiving surface 77 facing downward and extending along the surface 122 of the fixture 116. This inner surface portion 120 is parallel to the trim strip receiving surface 77. The "L"-shaped structures 64, 68 extend outside the edges of this surface portion 120. The inward-extending edges of curved portions 70, 74 fit, together with "L"-shaped structures 64, 66 extend downward within slots 124, which extend downward from surface 122 of the fixture 116.

The features of fixture 116 described above allow the extruded member, or a portion thereof, to be placed on the fixture 116 and moved in the longitudinal direction of arrow 126 and opposite thereto. Saw blade 102 forms a cutting plane having an angle 127 of 45 degrees with the guiding surface 122. In the vicinity of this saw blade 102, guiding tabs 128 are engaged within the attachment slots 63, 66 of the member being cut. These tabs 128 require that the member being cut must be brought toward the cutting plane in or opposite the direction of arrow 126. The fixture 116 also includes a stopping pin 130, which may be placed in any of three holes 132, 134,136 controlling the length of an end member 48, 49 being cut or into a hole 138 controlling length of the central member 46 as it is cut.

FIGS. 9–12 are isometric views of the sequential cutting operations occurring within the cutting apparatus 100 to form the mitered edges 78 of valance members 46, 48, 49.

Referring first to FIG. 9, before the miter cutting process is begun, the extruded member is cut into a predetermined-length portion 140. The length of this portion 140 is determined according to the type of valance to be constructed and the track length of the window covering with which the valance is to be used. For example, if the valance is being made for a 9 -cm (3.5-inch) IB valance system, which extends, along with the window covering, within a slot in a structure wall, the predetermined length is equal to the track length plus 21.6 cm (8.5 inches). If the valance is being made for a 9-cm (3.5-inch) OB valence system, which extends, along with the window covering, along the inner wall of the structure, the predetermined length is equal to the track length plus 39.4 cm (15.5 inches). If the valance is being made for a 5-cm (2-inch) OB valance system, the predetermined length is equal to the track length plus 26.7 cm (10.5 inches). Since, following the miter cutting process, the ends 142, 144 of the predetermined-length portion 140 become the square ends of the end members 48, 49, these cuts are made precisely, using apparatus of a well-known type, such as a table saw.

Referring to FIGS. 8 and 9, the position chosen for stopping pin 130 is also dependent on the type of valance structure being built, but not on the track length of the window covering. For example, if the valance is being made for a 9-cm (3.5-inch) IB valance system, the stopping pin 130 is placed in the leftmost hole 132. If the valance is being made for a 5-cm (2-inch) OB valance system, the stopping pin 130 is placed in the central hole 134. If the valance is being made for a 9-cm (3.5-inch) OB valance system, the stopping pin 130 is placed in the rightmost hole 136. In any case, the first mitering cut is made, in the configuration of FIG. 4, with the predetermined length member 140 placed against the stopping pin 130 in the appropriate hole 132, 134, 136, and with the member 140 extending from this pin 130 along the fixture 116 in the longitudinal direction opposite arrow 126. To make the first mitering cut, the rotating saw blade 102 is brought downward, in the direction of arrow 106 along the cutting plane 146. When this cutting process is completed, the end member 48 is removed from the mitering process.

Referring to FIGS. 8–10, after the cutting process of FIG. 9 is completed, the first remaining portion 148 from predetermined-length member 144 is rotated, so that the remaining square end 144 is brought into contact with the stopping pin 130, with the remaining portion 148 extending opposite the direction of arrow 126. This configuration is shown in FIG. 10. When the rotating saw blade 102 is lowered, the remaining end member 49 is cut away from the first remaining portion 148. Thus, the first two mitering cuts separate the end members 48, 49 from opposite ends of the original predetermined-length member 140. So long as these sections are formed from opposite, square-cut ends in this way, it is immaterial which of the end members 48, 49 is cut away first.

Referring to FIGS. 8,10, and 11, after the operations of FIGS. 9 and 10 are completed, the stopping pin 130 is next placed in the hole 138 controlling the length of central member 46 (shown in FIG. 2) as it is formed in the mitering process. At this point, the second remaining portion 150, from the operation of FIG. 10, has a surface 152 inclined at a 45-degree angle at each end, but these surfaces 152 are inclined in the wrong direction, decreasing the length of outer surface 62 below that of inner surface 60. Therefore, this second remaining portion 150 is next placed in the apparatus as indicated in FIG. 11, to extend from the stopping pin 130 in the direction of arrow 126. As the saw blade 112 is lowered in cutting plane 146, a first small scrap portion 154 is removed from a third remaining portion 156.

Referring to FIGS. 8, 11, and 12, after the operation FIG. 11, the third remaining portion 156 has an end 158 cut to be parallel to its remaining end 152. Therefore this third remaining portion is next placed in the apparatus as indicated in FIG. 7, to extend from the stopping pin in the direction of arrow 126, with the most recently cut end 158 facing away from cutting plane 146. When the saw blade 112 is again lowered within cutting plane 146, a second small scrap portion 160 is removed from the remaining portion, which is at this point formed as the central member 46. The process of cutting scrap portions 158,160 may be begun at either end of the second remaining portion 150, so long as a scrap portion 158, 160 is cut from each end of this portion 150.

FIG. 13 is an isometric view of a heating station 174 used in the forming of trim strip material 176 into the shape of decorative strip 52 (shown in FIG. 2), with heat-formed corners 54 defining end strip portions 56 and a central strip portion 58. The trim strip material 176 is composed of a thermoplastic material, such as polyvinyl chloride. The heating station 174 includes a heating unit 178 extending centrally from front to rear, having a resistive heater extending to provide a narrow band of heat along an upper surface 180, and a pressure pad 182, which is pivoted downward by means of a handle 184 rotating about a pivot shaft 186. The heating station 174 also includes a pair of support tables 187, along which the trim strip material 176 is placed.

Referring to FIGS. 2 and 13, before the process of selective heating in the heating station 174 is begun, the trim strip material is marked to determine the places at which the corners 54 will be formed. A successful method for placing these markings has been determined to be the placement of a flat portion 178 of the front surface 62 of central member 46 above the trim strip material 176, with pencil markings 188 then being made on the trim strip material 176 along each edge 78 of the flat portion 178. These pencil markings 188 must also be made with sufficient material remaining at each end of the trim strip material 176 to form an end strip portion 56.

The trim strip material 176 is placed on the upper surfaces 190 of tables 187, in alignment with a line 192, which in turn extends along these surfaces 190 in a direction perpendicular to the upper heating surface 180. This placement assures that a bend made along the heated portion of the trim strip material 176 is perpendicular to the edges of the trim strip material. Local heating occurs as the trim strip material is held against the upper heating surface 180 by means of the pressure pad 182. Then, before substantial cooling occurs, the trim strip material 176 is removed from the heating station 174 and bent downward at the heated area, placing the heated area in compression to a substantially perpendicular angle, which may, for example, include a ten-degree overbend compensating for the angle through which the material is expected to spring back as it cools.

For this bending process, satisfactory results have been obtained using a 310 heating element, with heat being applied for 1.5 seconds to a PVC strip having a thickness between 0.38 mm and 0.64 mm (0.015 inch and 0.025 inch), for 2 seconds to a PVC strip having a thickness between 0.66 mm and 0.89 mm (0.026 inch and 0.035 inch), for 2.5 sec for a PVC strip having a thickness between 0.91 mm and 1.02 mm (0.36 in and 0.40 in), and for 3 seconds to a PVC strip having a thickness between 1.04 mm and 1.14 mm (0.041 and 0.045 inch).

This process is next repeated at the other end of the trim strip material 176, with a second end portion 56 to be formed. This time, the associated pencil marking 188 is placed about 3 mm (0.125 inch) past the center of heating surface 180, in a direction elongating central portion 58 extending between the corners 54.

The process of assembling the various pieces of the valance 44 will now be discussed, with continuing reference being made to FIG. 2. This process begins with inserting a side 50 of a corner bracket 51 into the attachment slots 63, 66, at each end of central member 46. Next, the central portion 58 of formed decorative strip 52 is brought into place within the trim strip receiving slots 72, 76 of central member 46. Across most of the length of this central portion 58, this assembly step is facilitated by the fact that the decorative strip is easily bowed; at the ends it is snapped, where stiffness has resulted from the forming operation, the central portion 58 is snapped into place by squeezing it against the central member 46.

Next, the end members 48, 49 are slipped into place with the second legs 50 of corner brackets 51 extending within the attachment slots 63 and 66 of these end members. The desired lengths of the end portions 56 of the decorative strip 52 are indicated with pencil markings at the square ends of these end members 48, 49, which are then slipped off the legs 50 of corner brackets 51. The end portions 56 of the decorative strip 52 are cut at these pencil markings. Next, end members 48, 49, are reassembled onto the legs 50 of corner brackets 51, and with edges of the end portions 56 of the decorative strip 52 extending within trim strip receiving slots 72, 76 of each end member 48, 49. At this point, attachment brackets 53 may be assembled to the central member 46, being rotated into place in or opposite the direction of arrow 81 so that tabs 80, 82 are brought into attachment slots 63, 66.

While adhesives may be used to secure the attachment of end members 48, 49 and central member 46 to end members 51, they are generally not required because the frictional forces between both the brackets 51 and the end members 48, 49, and between the end portions 56 of decorative trim strip 52 and the end members 48, 49 are sufficient to hold these end members 48, and 49 in place. Furthermore, the shape of decorative trim strip 52 prevents outward movement of corner brackets 51, holding their legs 50 inserted fully within the associated slots 63, 66 of central member 62.

Figures 14, 15, 16:
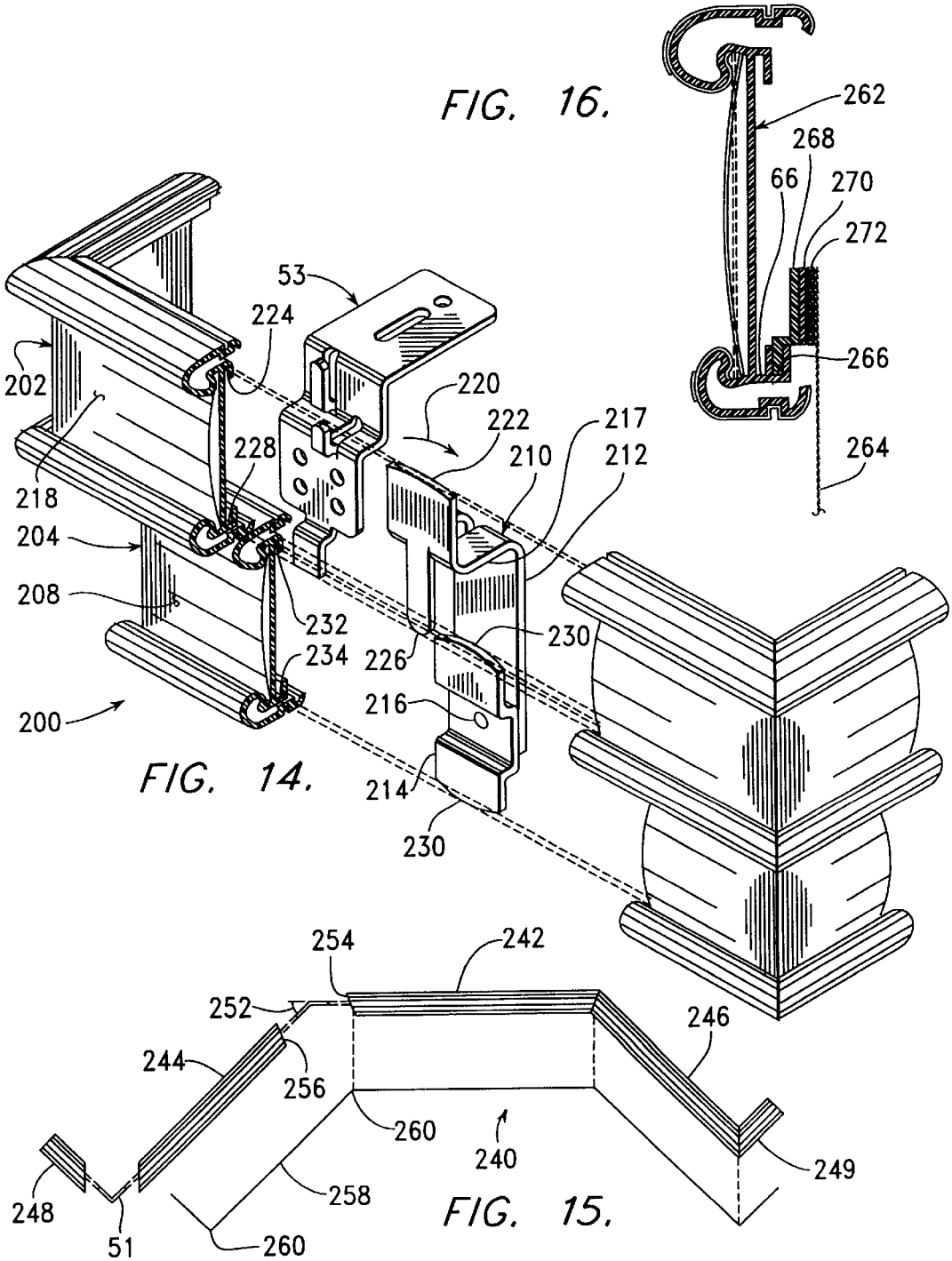
FIG. 14 is a fragmentary isometric view of an interconnected pair of the valances of FIG. 2.
FIG. 15 is a plan view of a valance made according to the present invention to fit within a bay window.
FIG. 16 is a transverse sectional view of an elongated member which is tormed as part of a frame of a valance.

FIG. 14 is a fragmentary isometric view of a valance 200 including an upper frame 202 and a lower frame 204, each of which is constructed as described above. For aesthetic reasons, both the end portions 206 and the central portion 208 of the lower frame 204 are displaced inward from the corresponding portions of the upper frame 202. The upper frame 202 is fastened to a corresponding building structure (not shown) using two or more attachment brackets 57 (one of which is shown), as described above in reference to FIG. 2. Two or more connecting brackets 210 (one of which is also shown) are used to attach lower frame 204 to upper frame 202.

Each connecting bracket 210 includes an upper segment 212 and a lower segment 214, which is rotatably mounted on the upper segment 212 at a pivot 216. The upper segment 212 includes an inward-extending section 217 providing for the inward displacement of the lower frame 204 relative to the upper frame 202. The upper segment 212 is brought into engagement with the central member 218 of upper frame 202 by pivoting this segment 212 in or opposite the direction of arrow 220, so that an upper tab 222 is brought into an upper attachment slot 224 of the central member 218, while a lower tab 226 is brought into a lower attachment slot 228 of this member 218. Next, the lower segment 214 is brought into engagement with the central member 208 of lower frame 204 by rotation about pivot 216, so that the opposing tabs 230 are individually brought into engagement with an upper attachment slot 232 and a lower attachment slot 234.

The number of attachment brackets 53 used to hold upper frame 202 in place within the building structure (not shown) is typically two or more, with the actual number being determined by the length of central member 218. Similarly, the number of connecting brackets 210 is typically two or more, with the actual number being determined by the length of central member 218. Additional connecting brackets 218 may be used to connect the lower frame 204 to a third frame (not shown) extending therebelow.

FIG. 15 is a partially-exploded plan view of an alternative valance 240 built in accordance with a version of the present invention to fit within a bay window. This alternative valance 240 includes a central member 242, a left member 244, a right member 246, and end members 248, 249. A corner bracket 51 is used as described above to fasten end member 248 to left member 244, and to fasten end member 249 to right member 246. Another version of a corner bracket 250, having opposing sides extending at an oblique angle 252, is used to fasten each of the members 244, 246 to the ends of central member 242.

Referring to FIGS. 3 and 15, in the alternative valance 240, the ends 254 of central member 242 and a single end 256 of each member 244, 246 are not cut at the standard miter angle of 45 degrees, but are rather cut at an angle bisecting the planes of the planar trim strip receiving surfaces 77 of the members to be joined. In this way, it is assured that a trim strip 258 formed at corners 260 extending perpendicularly between it longitudinal edges can be snapped or slid into the trim strip receiving slots 72, 76 of each member 242, 244, 246, 248, 249.

The process for manufacturing the alternative valance 240 is similar to that described above for manufacturing the valance 44. For cutting the ends 254 and 256, the sawing station 100, shown in FIG. 3, must be modified so that the saw blade is presented at a different angle 127, or a separate sawing station must be used for this purpose. When the trim strip 258 is formed, heat should be applied within the heating station 174 so that the portion of the strip 258 which will be placed in compression by the bend is the portion receiving heat.

FIG. 16 is a transverse sectional view of an elongated member 262 which is formed as part of a frame of a valance forming an alternative embodiment of the present invention. This embodiment is particularly adapted for supporting hanging fabric materials 264. The elongated member 262 is generally similar to the elongated member 84, which has been described in reference to FIGS. 2 and 3, with a difference being the addition of an upwardly-open fabric mounting slot 266, extending longitudinally adjacent the lower attachment slot 66. A fabric mounting strip 268 is inserted within the slot 266, so that the fabric materials 264 can hang downward from the frame. In a preferred version of this arrangement, a hook-type fastening strip 270 is fastened to the inner surface of the fabric mounting strip 268 by means of staples (not shown), while a loop-type fastening strip 272 is fastened to the fabric materials 264 by means of sewing. These fastening strips 270, 272 may be composed of materials sold under the trademark VELCRO by Velcro, U.S.A. This arrangement allows the fabric materials to be removed easily from the mounting strip 268 and replaced thereon if the fabric materials are to be cleaned or repaired. This arrangement can readily be configured in the form of valance 44, as described above in reference to FIG. 2, with the fabric materials descending from the lower frame 204 of valance 200, as described above in reference to FIG. 14, or in the form of valance 240, to fit within a bay window, as described above in reference to FIG. 15. The fabric materials may hang down from each section of the frame (such as from the central frame member 46 and end members 49 of the valance 44) or from only some of the sections (such as only from the central frame member 46 of the valance 44. Since the fabric mounting slot 266 is unobtrusive, the elongated member 262 can easily be used in applications not requiring a fabric hanging, providing an additional advantage of upgradability with fabric hangings after installation.

While the invention has been described in its preferred forms or embodiments with some degree of particularity, it is understood that this description has been given only by way of example and that numerous changes in the details of construction, fabrication and use, including the combination and arrangement of parts or process steps, may be made without departing from the spirit and scope of the invention.

What is claimed is

1. A method for constructing a valance comprising steps of:

a) cutting an elongated structural member to form a central member and first and second end members, with said central member extending between mitered ends, and with each said end member extending between a mitered and a squared end;

b) assembling said mitered end of said first end member to a first mitered end of said central member, with a first side of a first "L"-shaped corner bracket extending within upper and lower attachment slots of said first end member, and with a second side of said first "L"-shaped corner bracket extending within upper and lower attachment slots of said central member;

c) assembling said mitered end of said second end member to a second mitered end of said central member, with a first side of a second "L"-shaped corner bracket extending within upper and lower attachment slots of said second end member, and with a second side of said second "L"-shaped corner bracket extending within said upper and lower attachment slots of said central member;

d) forming a trim strip into a central portion essentially equal in length to said central member and first and second end portions extending in an inward direction essentially perpendicular to said central portion, with a sharp corner being formed between said central portion and each of said end portions; and e) inserting an upper edge of said central portion of said trim strip into an upper trim strip receiving slot within said central member, a lower edge of said central portion of said trim strip into a lower trim strip receiving slot within said central member, an upper edge of said first end portion of said trim strip into an upper trim strip receiving slot within said first end member, a lower edge of said first end portion of said trim strip into a lower trim strip receiving slot within said first end member, an upper edge of said second end portion of said trim strip into an upper trim strip receiving slot within said second end member, and a lower edge of said second end portion of said trim strip into a lower trim strip receiving slot within said second end member.

2. The method of claim 1, wherein said step a) includes steps of:

f) cutting said elongated structural member to a predetermined length with squared ends, wherein said predetermined length equals a track length of a window covering to be used with said valance, together with a distance determined in accordance with a type of said valance;

g) cutting said first and second end members from opposite ends of said predetermined length of said elongated structural member, with cuts being made at a 45-degree angle to longitudinally extending surfaces of said elongated structural member, so that, along each said end member, said outer surface extends farther than said inner surface;

h) forming said central member by cutting scrap portions from opposite ends of a portion of said predetermined length of said elongated structural member remaining after said step g), with cuts being made at a 45-degree angle to longitudinally extending surfaces of said elongated structural member, so that, along said central member, said outer surface extends farther than said inner surface.

3. The method of claim 2, wherein said step g) includes steps of:

i) inserting said predetermined length of said elongated structural member into first guiding surfaces engaging said longitudinally extending surfaces of said elongated structural member, with said predetermined length of said elongated structural member extending in a first direction from a cutting plane extending at a 45-degree angle from said first guiding surfaces;

j) sliding said predetermined length of said elongated structural member, in engagement with said first guiding surfaces, past said cutting plane, in a direction opposite said first direction, into engagement with a first stopping surface;

k) moving a saw blade along said cutting plane through said predetermined length of said elongated structural member held within said first guiding surfaces to form said first end member and a first remaining portion of said predetermined length of said elongated structural member;

l) inserting said first remaining portion into said first guiding structure with said first remaining portion extending in said first direction from said cutting plane, and with an end of said first remaining portion formed in said step k) directed away from said cutting plane;

m) sliding said first remaining portion, in engagement with said first guiding surfaces, past said cutting plane, in a direction opposite said first direction, into engagement with said first stopping surface;

n) moving said saw blade along said cutting plane through said first remaining portion portion held within said first guiding surfaces to form said second end member and a second remaining portion of said first remaining portion.

4. The method of claim 3, wherein, during said steps j) and m), a portion of said upper and lower attachment slots is moved over second guiding surfaces holding a section of said elongated structural member within said first guiding surfaces.

5. The method of claim 3, wherein said first stopping surface is movable among a plurality of positions to determine a length of said first and second end members.

6. The method of claim 3, wherein said step h) includes steps of:

o) inserting said second remaining portion into said first guiding structure with said second remaining portion extending in said direction opposite said first direction from said cutting plane;

p) sliding said second remaining portion, in engagement with said first guiding surfaces, past said cutting plane, in said first direction, into engagement with a second stopping surface;

q) moving said saw blade along said cutting plane through said second remaining portion held within said first guiding surfaces to form a first of said scrap portions and a third remaining portion of said second remaining portion.

r) inserting said third remaining portion into said first guiding structure with said third remaining portion extending in said direction opposite said first direction from said cutting plane, and with an end of said third remaining portion formed in said step q) directed away from said cutting plane;

s) sliding said third remaining portion, in engagement with said first guiding surfaces, past said cutting plane, in said first direction, into engagement with a second stopping surface;

t) moving said saw blade along said cutting plane through said second remaining portion held within said first guiding surfaces to form said central member and a second of said scrap portions.

7. The method of claim 6, wherein, during said steps j), m), p), and s), a portion of said upper and lower attachment slots is moved over second guiding surfaces holding a section of said elongated structural member within said first guiding surfaces.

8. The method of claim 1, wherein said step d) includes steps of:

u) holding said trim strip against a heated strip, with longitudinal edges of said trim strip extending perpendicularly to said heated strip, and with a portion of said trim strip to become said first end portion thereof extending from said heated strip;

v) bending said trim strip while a portion thereof heated from said step u) through a right angle;

w) holding said trim strip against said heated strip, with longitudinal edges of said trim strip extending perpendicularly to said heated strip, and with a portion of said trim strip to become said second end portion thereof extending from said heated strip;

x) bending said trim strip while a portion thereof remains heated from said step w) through a right angle.

9. The method of claim 1, wherein said step a) is preceded by extruding said elongated member.

10. The method of claim 9, wherein said step of extruding said elongated member includes steps of:

extruding a first thermoplastic material through a slot in a first die;

forcing a second thermoplastic material including a coloring agent into a trough adjacent an aperture in a second die, wherein said aperture is approximately shaped as a transverse section of said elongated member, and wherein said trough is adjacent a portion of said aperture corresponding to a visible portion of said elongated member; and forcing said first thermoplastic material, with a partial coating of said second thermoplastic material extending adjacent said trough, through said aperture in said second die.

11. The method of claim 10, wherein said step of forcing said first and second thermoplastic material through said aperture in said second die is followed by steps of:

moving said first and second thermoplastic material through a chamber in said second die, with compressive stresses within said thermoplastic material being relieved in said chamber; and forcing said first thermoplastic material, with a partial coating of said second thermoplastic material through an aperture in a third die, wherein said aperture in said third die is approximately shaped as said transverse section of said elongated member.

* * * * *